US012745859B2

(12) United States Patent
Keller

(10) Patent No.: US 12,745,859 B2
(45) Date of Patent: Sep. 29, 2026

(54) DRIVE SYSTEM, SWING HAMMOCK SYSTEM, AND METHOD FOR SIMULATING AN ELASTIC TENSIONING ELEMENT

(71) Applicant: Explicatis GmbH, Cologne (DE)

(72) Inventor: René Keller, Odenthal (DE)

(73) Assignee: Explicatis GmbH, Cologne (DE)

( * ) Notice: Subject to any disclaimer, the term of this patent is extended or adjusted under 35 U.S.C. 154(b) by 82 days.

(21) Appl. No.: 18/555,595

(22) PCT Filed: Apr. 20, 2022

(86) PCT No.: PCT/EP2022/060396
§ 371 (c)(1),
(2) Date: Oct. 16, 2023

(87) PCT Pub. No.: WO2022/223602
PCT Pub. Date: Oct. 27, 2022

(65) Prior Publication Data

US 2024/0206643 A1 Jun. 27, 2024

(30) Foreign Application Priority Data

Apr. 20, 2021 (DE) ..... 102021110005.4

(51) Int. Cl.
*A47D 9/02* (2006.01)

(52) U.S. Cl.
CPC ..... *A47D 9/057* (2022.08)

(58) Field of Classification Search
CPC . A47D 9/057; A47D 1/10; A47D 9/02; A47D 13/107; A47D 13/10; A47C 3/0255; A47C 3/0251; A47C 17/84; A47C 21/006
(Continued)

(56) References Cited

U.S. PATENT DOCUMENTS 5,833,545 A * 11/1998 Pinch ..... A47D 9/057 472/119
10,835,835 B2 * 11/2020 Lee ..... A63G 9/16
(Continued)

FOREIGN PATENT DOCUMENTS

AU 2018420659 A1 12/2020
CN 201324063 Y 10/2009
(Continued)

OTHER PUBLICATIONS

International Preliminary Report on Patentability for Application No. PCT/EP2022/060396; mailed Jul. 10, 2023; 31 pp.
(Continued)

*Primary Examiner* — Justin C Mikowski
*Assistant Examiner* — George Samuel Gines
(74) *Attorney, Agent, or Firm* — Bodman PLC

(57) ABSTRACT

Drive system (2) for a spring cradle system (100), in particular for a child's or baby's spring cradle, for generating an oscillating movement, comprising a tension element (4) with a distal end adapted to be fixed to an oscillating element, a drive unit (21) adapted to increase and decrease a free length of the tension element (4) to change a position of the oscillating element relative to the drive system (2), and a control unit (22) adapted to control the drive unit (21) so that a pretensioning force acts on the tension element (4) regardless of the position of the oscillating element relative to the drive system (2). Further provided is a spring cradle system (100) comprising the drive system and a method for simulating an elastic clamping element.

13 Claims, 8 Drawing Sheets

Figure 1:
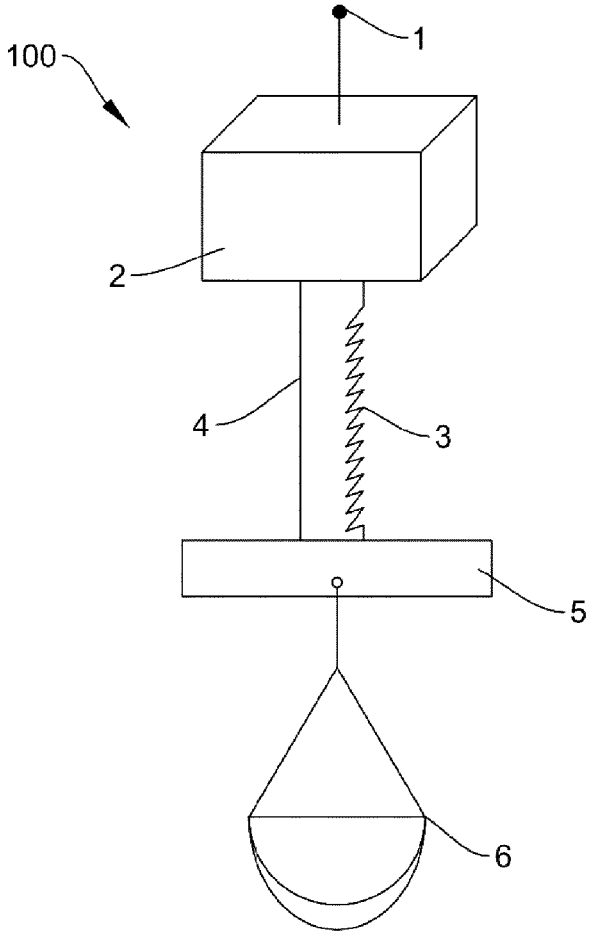

(58) Field of Classification Search
USPC ..... 5/104, 108, 128; 297/273, 260.2
See application file for complete search history.

(56) References Cited

U.S. PATENT DOCUMENTS

| | | | | |
|---|---|---|---|---|
| 2001/0027135 | A1* | 10/2001 | Lawson | A47C 17/84<br>472/119 |
| 2005/0283908 | A1 | 12/2005 | Wong et al. | |
| 2008/0217974 | A1 | 9/2008 | Velderman et al. | |
| 2011/0127810 | A1* | 6/2011 | Lee | A47D 13/101<br>297/16.1 |
| 2012/0119549 | A1* | 5/2012 | Speedie | A47D 9/02<br>297/217.3 |
| 2017/0208964 | A1* | 7/2017 | Luginin | A47D 9/057 |
| 2018/0014659 | A1* | 1/2018 | Patil | A47D 15/00 |

FOREIGN PATENT DOCUMENTS

| | | | | |
|---|---|---|---|---|
| CN | 108771392 | A | 11/2018 | |
| DE | 19848962 | A1 | 2/2000 | |
| DE | 102011013373 | A1 * | 9/2012 | A47D 11/00 |
| DE | 102019117876 | A1 | 1/2021 | |
| DE | 112018007533 | T5 | 1/2021 | |
| DE | 202021101392 | U1 | 3/2021 | |
| GB | 2246068 | A | 1/1992 | |
| WO | WO-2010098702 | A1 * | 9/2010 | A47D 9/04 |

OTHER PUBLICATIONS

International Search Report & Written Opinion for Application No. PCT/EP2022/060396; mailed Sep. 8, 2022; 14 pp.

* cited by examiner

DRIVE SYSTEM, SWING HAMMOCK SYSTEM, AND METHOD FOR SIMULATING AN ELASTIC TENSIONING ELEMENT

CROSS-REFERENCE TO RELATED APPLICATIONS

This application is a U.S. National Stage Application under 35 U.S.C. § 371 of International Application No. PCT/EP2022/060396, filed Apr. 20, 2022, which claims the benefit of and priority to German Patent Application No. DE 10 2021 110 005.4, filed Apr. 20, 2021, the contents of which are hereby incorporated herein by reference in their entireties.

The present invention relates to a drive system for a spring cradle, a spring cradle system, and a method for simulating an elastic clamping element.

There are numerous spring cradles preferably for babies and children. Usually, such a spring cradle consists of a lying device similar to a stretcher, which is attached to a spring suspension. The spring suspension is connected via an elastic oscillating element, usually a spring, to a suspension, which is suspended from a frame or other support such as a doorframe, etc. in a free-swinging manner. In most cases, a load-bearing drive system is mounted on this suspension. The drive system includes an electric motor that periodically exerts a pulling force on the spring suspension via a tension element, causing the stretcher to oscillate up and down.

In known spring cradles, the drive system is connected to the spring suspension via the tension element, wherein the tension element is kept permanently under tension. This is necessary so that the drive system receives information about the inward and outward spring movement, for example, in order to apply the tensile force in the upward spring movement and not to apply any force in the downward spring movement. Since the oscillation amplitude varies depending on the installed spring, weight (child plus stretcher, plus accessories, etc.) and applied force, the tension element is equipped with a mechanical clamping element to ensure that the tension element is permanently under tension. This clamping element is usually implemented as a spiral spring on the drive shaft of the motor. The clamping element ensures that the tension element is continuously connected to the drive system, regardless of the deflection of the spring, despite variable distances resulting from the weight of the child or stretcher, the installed springs, the amplitude intensity depending on the drive energy, etc. This ensures that a sensor, such as a servomotor or dynamo, can pick up information about the oscillation speed and direction and thus control the energy to amplify or maintain the oscillating motion.

The problem with this design is that the mechanical clamping element does not allow silent operation of the drive system. In practice, noise levels of up to 63 db (A) are sometimes generated by the drive system.

EP 3 197 323 B1 relates to a device for producing a rocking motion on supports for babies, comprising a frame arranged on a base and having a support arm, and a tension means designed to suspend the support.

DE 10 2018 006 463 A1 relates to a spring cradle suspended from an elastic element and vibrated by an eccentrically rotating mass.

However, the above problem is neither addressed nor solved in the prior art. Therefore, the present invention sets out to provide a drive system for a spring cradle, a spring cradle system, and a method for simulating an elastic clamping element that solves the above problem.

The object is solved by a drive system for a spring cradle with the features of claim 1, a spring cradle system with the features of claim 10 and a method for simulating an elastic clamping element with the features of claim 12.

According to one aspect of the present invention, there is provided a drive system for a spring cradle system, in particular for a child or baby spring cradle, for generating an oscillating motion, comprising:

- a tension element having a distal end configured to be attached to an oscillating element,
- a drive unit configured to increase and decrease a free length of the tension element to change a position of the oscillating element relative to the drive system, and
- a control unit configured to control the drive unit so that a pretensioning force acts on the tension element regardless of the position of the oscillating element relative to the drive system.

Accordingly, a drive system for spring cradles is provided which operates without a mechanical clamping element. Consequently, the drive system can be operated almost silently. Furthermore, the longevity is increased as fewer mechanical components are used. According to one embodiment, the functionality of a mechanical clamping element can be algorithmically imitated via a microcontroller-based control of the drive unit. Thus, no mechanical clamping element is necessary in the drive system.

The drive system comprises a drive unit, such as an electric motor with a rotating shaft. Via this shaft, the tension element, such as a rope, can be rolled up by rotation, whereby a tension force is transmitted through the tension element in the direction of the drive system. Thus, for example, the oscillating element can be moved in the direction of the drive system. In doing so, the tension element can be rolled up onto a roller or roller located on the shaft of the drive unit. When the drive unit is not in operation and the oscillating element moves away from the drive system, the tension element can unroll from the roller so that the shaft of the drive unit rotates in the opposite direction. Thus, the free length of the tension element (i.e., the portion of the tension element that corresponds to the distance between the drive system and the oscillating element) can be varied. By varying the free length of the tension element, an oscillation of the oscillating element can be initiated. An oscillating motion executed by the oscillating element may be a motion whose sequence repeats itself in the same or very similar form periodically or according to predefined motion patterns, in particular complex motion patterns. The motor may be directly connected to a roller. In other words, in this case, no gear or the like may be provided between the motor and the roller. Thus, the force effect can be efficiently developed and large leverage effects can be avoided. In addition, a small roller may be provided. For example, the diameter of the roller may be substantially the same as the rotor diameter of the motor. However, the smaller the diameter (e.g., the inner diameter) of the roller, the more frequently the tension element (e.g., a rope) winds up on top of each other. This can result in random, uncontrollable slippage of the tension element as it piles up at one point and slips back down. Therefore, the drive system may be provided with a single-track rope roller as a roller. More details on the robe roller follow below. Nevertheless, it is also conceivable to provide a gearbox which is provided between the motor and the roller in order to translate and/or reduce the drive energy of the motor.

The tension element can be a ribbon-like element, such as a rope or a cord, which is designed to support the oscillating element together with a person accommodated therein. A proximal end of the tension element may be connected to or engaged with the roller so that the tension element is held to the roller even when the tension element is no longer wrapped around the roller. The distal end of the tension element may be the end of the tension element opposite to the proximal end, which is connected or connectable to the oscillating element. A region (i.e., a particular length region) of the tension element that is not wrapped around the roller may define the free length of the tension element.

The drive unit can be an electric motor, which generates a rotary motion by supplying current and transmits it to a roller, for example, by means of a shaft. The direction of rotation of the electric motor can be varied. For example, the drive unit may have sensors that can measure the current applied to the drive unit and thus provide information about the operation of the drive unit. Further, the rotational energy output by the drive unit may be measured. Thus, by supplying a predetermined current to the drive unit and determining an output of the drive unit, the control unit can determine whether or not the tension element is connected to the oscillating element with tension. Thus, the pretensioning force may be determined by a defined power supply (for example, by applying a certain voltage) to the drive unit.

In this case, the oscillating element may comprise a stretcher or cradle for holding at least one person and a suspension device from which the stretcher is suspended.

By controlling the drive unit, the control unit can ensure that the tension element is always connected to the oscillating element under tension. For this purpose, a sufficiently high minimum force (preload) can be applied to the tension element, which pulls the tension element towards the drive system (i.e. applies a torque to the shaft so that the roller is rotated until the tension element is connected to the oscillating element under tension). In this case, the minimum force may be less than the weight force of the oscillating element without the person accommodated therein. As soon as no more movement of the tension element is registered, the tension element is "under tension" and establishes a direct connection of the oscillating element with the drive unit. Further application of a preload is then no longer necessary, which is why the drive unit can be switched off. The drive system is thus in the idle state. The control unit can thus simulate the mechanical clamping element used to maintain the tension of the clamping element in known spring cradles. However, while in a mechanical clamping element the tensioning force has a damping effect on a downward oscillating movement of the oscillating element and must be compensated by a driving energy, the control unit of the drive unit generates a pretensioning force (tensioning force) for maintaining the tension of the clamping element only when this is necessary. Therefore, the drive system of the present invention can be operated more efficiently.

As soon as the control unit registers a movement of the tension element and the system is in the idle state, the control unit can control the drive unit so that the pretension is applied to the tension element. This can ensure a direct connection of the tension element to the oscillating element. This is advantageous, for example, when a person is loaded into a device suitable for this purpose on the oscillating element.

As soon as the control unit detects that the oscillating motion is moving away from the drive system, the drive unit can be controlled in such a way that no more preload is applied to the tension element. Otherwise, the drive unit would generate a force against the direction of oscillation, which would negatively affect the electronics, energy consumption and oscillation intensity.

Preferably, the tension element is provided on the drive system such that it extends away from a central point of the drive unit. The central point of the drive unit may be the center of gravity of the drive unit. In other words, the central point of the drive unit may be the center of gravity of the drive unit in a top view (in the gravity direction) of the drive unit. In particular, by omitting a mechanical clamping element, the drive unit may be configured to guide the tension element centrally out of the drive unit. In other words, the tension element can be guided out of the drive unit at the center of gravity of the drive unit. From products known in the prior art, the tension element is arranged offset (i.e. off-center) from a center of gravity of the drive unit. Thus, the oscillating element is also arranged off-center below a drive unit. In such a case, if the drive unit is attached to a rope or a door clamp, for example, this offset induces a pendulum motion that results in a swing-up of the overall system. A rocking pendulum motion does not occur when the tension element is centered in the drive unit.

Furthermore, the drive unit is designed to enable automatic, hands-free operation. This can comprise two modes in particular. Firstly, in a stand-by mode, it can be monitored whether a deflection of the oscillating element occurs, which occurs, for example, when a child is engaged. If deflection is detected, it can be checked whether an oscillating motion can be generated. An oscillating motion can be generated if the oscillating element can oscillate freely. If this is the case, the drive unit can enter an operating mode. Thus, the drive system can automatically activate (i.e., enter the operating mode) as soon as a deflection of the oscillating element is detected.

In the stand-by mode, a short, minimal force pulse can be applied to the oscillating element at periodic intervals to pull the tension element tight. If the operating state is activated, it can be checked whether an external influence leads to a drastic reduction of the oscillating intensity. If such a reduction in oscillating intensity is detected, the drive system can enter a cool-down mode and activate the stand-by mode after the system has come to a standstill. This automatic change between different operating modes can be deactivated or activated by a user.

The control unit can comprise a single-board computer provided with a standardized operating system, such as Linux, so that any standard components can be connected. For example, the control unit may include a standardized interface such as a USB port, SD card reader, or the like. Furthermore, access may be provided for developers to provide plug-ins to provide further functionalities of the drive system using these standard components. For example, the control unit can be provided with further control sequences to execute individual oscillating patterns.

The drive system can have a single-track rope roller with which the tension element can be wound and unwound. Due to the single-track rope roller, skipping of the tension element can be prevented, as could occur, for example, with an uncontrolled multi-track rope roller. Accordingly, noise and vibrations during operation due to uncontrolled skipping of the tension element (for example a rope) on the roller are excluded and safe operation of the drive system can be ensured. Alternatively, it is conceivable to provide a rope roller with a guided track in conjunction with a rope guide, which results in a constant torque and also improves the measurement accuracy via any rotation sensor, since the rotation speed remains almost constant regardless of the length of the tension element. Consequently, a constant force can be transmitted from the drive unit to the tension element and vice versa. Accordingly, particularly uniform operation of the drive system can be ensured.

According to one aspect of the present invention, the drive system may have a powerful motor as a drive unit in combination with a guided track for the tension element, a guide for the tension element and a mechanical lock as well as a recuperation device. Thus, a spring cradle system can also be realized without an elastic oscillating element. Thus, the aesthetic appearance of the spring cradle system can be improved and yet the same functionalities can be provided as with an elastic oscillating element.

Furthermore, the drive system can have a mechanical lock that can prevent the tension element from deflecting. Thus, the distal end of the tension element can be prevented from displacing. Consequently, the distance between the drive system and the oscillating element can be kept constant regardless of the load applied to the oscillating system. This is advantageous, for example, when a child or baby is being loaded into or removed from the oscillating system.

According to another aspect of the present invention, the drive system may be designed to carry a payload by suspending the drive system from a stationary mount and in turn suspending an oscillating element (e.g., a payload device) over at least the tension element. Preferably, in addition to the tension element, a resettable element (e.g., an elastic element) is provided between the oscillating element and the drive system. Alternatively, the drive system may be designed not to carry a payload. In this case, the drive system can, for example, be placed on a frame and connected to the oscillating element via the tension element. In this case, the oscillating element can be attached to a frame or other device directly or indirectly (e.g. via an elastic element).

Preferably, the drive system is arranged above (with respect to the direction of gravity) the oscillating element so that the pretensioning force is applied to the tension element in the opposite direction to the earth's gravity. Nevertheless, the drive system can also be provided below the oscillating element so that the pretensioning force is applied to the tension element in the direction of the earth's gravity.

In accordance with one aspect of the present invention, longevity may be provided by not using mechanical sensors. For example, only non-mechanical sensors may be used to determine a position of the oscillating element relative to the drive system. By using a microcontroller-based intelligent control unit, an energy-optimal oscillating motion can be realized since no mechanical sensors dampen the oscillating motion and only minimal frictional losses exist. The intelligent control of the control unit can further ensure that only minimal oscillation energy is expended for a calm behavior of the child/baby.

Preferably, the drive system further comprises at least one sensor for determining a displacement of the distal end of the tension element, wherein the at least one sensor is preferably a non-contact sensor.

The mechanical sensors used in the prior art to measure the oscillating speed and direction, e.g. via dynamos and servomotors, have a negative impact on the durability of the drive system, as these components can wear out quickly. Furthermore, sustainability is negatively affected because the production of these components costs energy and dynamos in particular dampen the oscillating motion and thus require more tensile force. In addition, mechanical components generate noise, especially whirring operating noises from actuators.

To measure the displacement of the oscillating motion, a non-mechanical sensor can be used which can measure the displacement of the distal end of the tension element (i.e. a movement of the tension element). This may be an optical motion sensor, which may optionally measure a rotation of a shaft of the drive unit and/or a speed of the tension element. Nevertheless, other sensors can be used for the measurement, such as ultrasonic sensors or electromagnetic sensors (e.g. Hall sensor). The sensors can be used to measure the movement of the tension element directly on the tension element itself, on the shaft of the drive unit, directly in the motor, on the roller, or on an additional component such as a pole wheel that rotates together with the shaft. In other words, the motor can be a 3-phase motor, for example, which has integrated sensors.

Thus, the drive unit can be an actuator that is controlled by the control unit based on a control logic. For this purpose, the control unit can receive sensor data (i.e. measured values) from the at least one sensor and process them further. As a result of the further processing, the control unit can output control commands with which the drive unit can be controlled. A standardized single-board computer, preferably Raspberry Pi, can be used as a control unit, which can control the drive unit and receive and process the sensor data. However, other controllers can also be used as a control unit.

In accordance with one aspect of the present invention, when the drive system is started, the tensile force of the drive unit must apply more energy to vibrate the oscillating element than is necessary to maintain an oscillating motion of the oscillating element, since the complete weight of the oscillating element must be moved against the force of gravity. The problem, however, is that too strong a tensile force when the weight of the oscillating element is low can lead to jerky unintended strong acceleration or unintended exceeding of the permissible oscillation amplitude. Therefore, the control unit can be designed to control the drive unit in very short time intervals (a few milliseconds) in order to influence a movement of the tension element. In parallel, the displacement of the distal end of the tension element can be measured via the at least one sensor and the control of the drive unit can be adjusted based on this measurement data. Accordingly, the tensile force of the drive unit can be actively controlled. Furthermore, it is possible to start with a small tensile force (for example 10% of the maximum tensile force or the maximum power of the drive unit). The drive unit can have a power of 2 W to 10 W. The drive unit can be operated with 12 V direct current. This ensures efficient operation of the drive unit. In the case of use as a drive for a spring cradle for children, the power of the drive unit is preferably between 3 W and 5 W. A power of 3.8 W has been shown to be particularly efficient (at 12V DC, i.e., 0.6 A). The tensile force can then be increased until a deflection is measured via the at least one sensor. At each oscillating motion (e.g., at half a period), the ratio of actual to desired oscillation amplitude can be checked and control of the drive unit by the control unit can be adjusted to achieve the desired oscillation amplitude. The closer the oscillation amplitude reaches the desired target value of the oscillation amplitude (i.e., oscillation intensity) that can be set via a controller, the less tensile force is applied by the drive unit in order to achieve the desired oscillation amplitude as gently as possible. For this purpose, the desired minimum number of oscillation amplitudes until the desired oscillation intensity is reached can be stored as a configuration parameter in a memory of the control unit. Thus, the control unit can control the drive unit in such a way that the desired oscillating amplitude is reached very gently or in such a way that the desired oscillating amplitude is reached quickly. Thus, the drive unit can be adapted to any requirements and individually controlled by the control unit.

Thus, the control unit can be designed to initiate actions (i.e., to control the drive unit) and to check a result thereof (i.e., the oscillation that has occurred) to determine whether it corresponds to the expected result. In case of deviations, conclusions can be determined, for example, by an artificial intelligence or rule-based system, which can optionally be displayed to the user and/or lead to an adjusted control by the control unit. In this way, damage to the drive system and/or external disturbing factors can be detected at an early stage and communicated to the user (for example, a defect in the tension element, a foreign body in the oscillation range, resistance during spring deflection, etc.).

By controlling the control unit, the drive system can have a so-called "cool-down" functionality, which dampens the oscillating movement when it is switched off by accelerating the amplitude in the opposite direction and prevents a post oscillation using the force of the drive unit. For this purpose, it is possible to specify how many oscillating movements are to be executed in order to stop the oscillating motion.

Furthermore, the drive system can be controlled by the control unit according to a stand-by functionality or hold functionality, in which the drive unit is controlled in such a way that the distance between the oscillating element and the drive system remains as constant as possible in order to simplify the loading and unloading of a person into the oscillating element. Here, a movement of the tension element can be detected and the drive unit can be controlled to generate a tensile force in the opposite direction.

In addition, the control unit can have an emergency stop functionality that can be triggered via a dedicated switch, a control element and all control elements connected via the Internet, such as voice assistance, app, etc. This emergency stop function uses the maximum available force of the drive unit to stop the oscillating motion as quickly as possible. This means that in an emergency situation, operation of the drive unit can be stopped as quickly as possible.

Preferably, the drive system further comprises an electronic shutdown device, wherein the control unit is arranged to periodically send operating signals to the shutdown device, and wherein the shutdown device is arranged to automatically cut off power to the drive unit when it is not receiving operating signals. In other words, the drive system may have an electronic shutdown device or emergency stop assembly (for example, a relay) that is turned off to automatically cut off power to the motor when no more signals (for example, from a signal unit) are received. The electronic shutdown device may be part of the control unit. This is to protect a burnout of the motor (i.e., the drive unit). This could occur, for example, if the control software of the control unit malfunctions or "hangs", or if a single-board computer provided in the control unit malfunctions during operation while voltage is applied to the motor. Further, the drive unit and/or the control unit may be configured to send signals to the electronic shutdown device during operation (for example, from a signal unit) to prevent power shutdown. This emergency shutdown can also be initiated by the control unit if sensor readings indicate a system malfunction that makes further operation impossible, for example if the tension element is cracked or blocked. Operating signals can be, for example, operating commands or standardized signals sent at a predetermined time interval. This can increase operational reliability.

Furthermore, the control unit can be designed (for example by means of control software) to continuously check the sensor values and/or outgoing control signals. If deviations from an intended behavior occur, a fault can be logged. In this way, faults that prevent operation, such as a cracked or blocked tension element, can be distinguished from faults that restrict operation, such as reduced motor performance. The control unit can be designed to communicate such faults to a user in the form of notifications (e.g. via app, housing LED, etc.).

According to a further embodiment, the drive system may comprise a force sensor configured to detect the force applied to the tension element.

The force sensor can be a strain gauge, a piezo force transducer or the like. Thus, a force acting on the tension element can be measured. By changing it, the control unit can infer different states of the oscillating element. For example, an abrupt increase in the force acting on the tension element may be indicative of a stuck condition or an unintended external interference with the oscillating motion of the oscillating element. Further, a sudden decrease in the tensile force can determine that a person has been removed from the oscillating element or has fallen out. In addition, the force sensor can be used to determine if the tension element is sagging or connected to the oscillating element with tension. This is the case if the preload force applied by the drive unit can be measured with the force sensor. The control unit can then determine that the tension element is connected to the oscillating element with tension.

According to a further embodiment, the control unit is designed to control the drive unit based on the force detected by the force sensor.

Based on the information obtained by the force sensor, the control unit can react. For example, it can stop the operation of the drive unit in the event of an abrupt increase in the tensile force in the tension element in order to prevent possible damage. Additionally, an indication can be output to an interface or output device. Likewise, if there is an abrupt decrease in the tensile force in the tension element, the control unit may stop operation of the drive unit and/or output an alert. Furthermore, the information about the force acting in the tension element can be used to check whether the tension element is tensioned or sagging. As soon as the control unit detects that the tension element is under pretension, it can assume that the tension element is under tension and therefore not sagging.

Preferably, the preload force is less than 15% of the maximum power of the drive unit, preferably less than 10% of the maximum power of the drive unit, and more preferably less than 8% of the maximum power of the drive unit.

The pretensioning force can be greater than the force resulting from the tension element's own weight. As soon as the pretensioning force is greater, the tension element can be tensioned. In this case, a force resulting from the dead weight of the oscillating element and any person accommodated therein need not be exceeded, since the pretensioning force is only intended to tension the tension element and not to move the oscillating element. The maximum power of the drive unit can result from the intended use of the drive unit. If relatively heavy objects and/or persons are to be oscillated with it, the drive unit can have more power. At the same time, however, the tension element must also be of a correspondingly stable design in order to be able to carry a relatively heavy load. It has been found that at a preload that is less than 15% of the maximum power of the drive unit, the tension element can be reliably preloaded so that sagging of the tension element can be avoided. This also applies to the case where the tension element runs at least partially at an angle to the vertical. A value smaller than 10% of the maximum power is particularly advantageous if the tension element runs vertically, since less force is then required to put the tension element under tension (i.e. to pull it smoothly). The range of less than 8% offers particular advantages when the drive unit is used with spring cradles for children or babies, as this allows the spring cradle to be operated particularly efficiently and quietly. In addition, this preload is sufficient for a tension element that is often filigree in this case.

Preferably, the control unit is further designed to control the drive unit such that the oscillating element performs a predetermined oscillating motion.

Microcontroller-based control of the control unit enables more complex oscillation patterns than simply a uniform continuous oscillating motion. For example, an oscillation pattern similar to that during a car ride can be imitated. Post-oscillation can be prevented by the stop function, which dampens the oscillating movement until it comes to a standstill and suppresses vibration by manual intervention. Reaching the desired oscillation intensity can be achieved algorithmically by varying force application in a desired duration (i.e., possibly fast) and then maintained at a level. The control unit can detect a varying load in the oscillating element (for example, by the above force sensor and/or by measuring an amplitude of the oscillating element) and control drive unit accordingly so that the applied force is matched to the payload (i.e., to the weight of the oscillating element and any persons accommodated therein). Likewise, the control unit can detect operation outside a permissible oscillation range and thereupon execute a warning and/or an emergency stop.

The control unit can measure the oscillation displacement. If the oscillation displacement is plotted on a Y-axis and the time on an X-axis, a harmonic oscillating movement can be represented in a curve similar to a sinusoidal curve. In this case, the oscillating velocity may be highest approximately when passing the equilibrium point (i.e., the rest point of the non-oscillating state) and may become lower as it approaches the minimum or maximum deflection (i.e., the reversal point). The control unit can use the knowledge of the oscillatory trajectories to activate the simulation of the tension element described above shortly before the reversal point is reached, so that the tension element remains constantly connected to the oscillating element under tension for the entire duration of the oscillatory motion.

Furthermore, the control unit can measure a deviation from the expected oscillation deflection in order to adjust or switch off the control of the drive unit. For example, the control unit can detect when the oscillation curve deviates from the sinusoidal curve, for example if no measured values are recorded at the upper reversal point. Furthermore, the control unit can be designed to measure a deviation of the actual oscillating motion from predetermined complex oscillating patterns (e.g. simulation of a car ride) and to adjust the control of the drive unit according to the complex oscillating pattern. In this case, the set force in relation to a spring used (as an example of a resettable element) and the weight of the oscillating element is too large and the spring reaches a state in which it cannot compress further. This undesirable event can be detected by the control unit and corrected by automatically reducing the maximum force exerted by the drive unit.

A user can further control the intensity of the oscillating movement via an interface. In doing so, the user can vary the intensity via a controller (plus/minus rocker switch, potentiometer, control via a mobile app or electronic control panel). Based on the oscillating motion in relation to the applied force, the control unit can detect whether a lower limit or upper limit has been reached and prevent operation outside these ranges. The lower limit of an oscillating motion is reached when harmonic oscillation is no longer possible because, alternatively, the motion would be so small that it would no longer be perceived as an oscillation or the detection accuracy of the control unit and/or the sensors is undercut so that they can no longer measure an oscillating motion. The upper limit is reached when, as described above, no upper reversal point can be measured. In this case, the force applied by the drive unit can be reduced by the control unit to such an extent that the upper limit reaches a harmonic oscillating motion.

In a preferred embodiment, the control of the oscillating motion can be performed via slide or rotary controls as well as rocker buttons (+,–) on the drive system or can be regulated by corresponding visualizations on the surface of a touch screen or an app. In accordance with one aspect of the present invention, the user can set the oscillation intensity in an interval of minimum and maximum oscillation intensity. Thus, the user can set the predetermined oscillating motion. If the user sets the controller to any value, a small force is first applied and the effect of the force on the oscillation is measured. The force is increased at fixed time intervals (for example, in 0.5 s or 5 ms increments) until the control unit can detect a deflection. Then the control unit can determine one of the weight of the oscillating element and/or characteristic values of a cradle. The force control is successively adjusted until the oscillation amplitude reaches the set value. Ergo, at the beginning the force increases until the oscillating element starts to move and the closer the oscillation gets to the set intensity, the lower the force becomes until, when the set oscillation intensity is reached, it only contributes to maintaining the oscillating movement.

Preferably, the drive unit is designed to apply a variable force to the tension element. Thus, the drive unit can be designed to apply a force to the tension element variably over an oscillation cycle. In other words, the total force per oscillation can be applied variably or constantly over the entire upward motion. In a preferred embodiment, a lower current is applied at the extreme point of the oscillating motion (e.g., at the inflection point of the oscillating element) than at the apex of the oscillating motion, where the velocity is highest. In particular, this ensures that the tension element undergoes a smooth transition when changing direction, even in the presence of any external disturbances, abrupt application of full motor power can lead to unwanted acoustic effects. Furthermore, it proved to be more energy-saving to apply the required tractive force in a period of greater movement speed, and it also leads to a more natural movement because it corresponds to an acceleration characteristic in manual oscillation with the hand.

The control unit can further regulate the intensity automatically. In this way, a minimum oscillating movement can initially be brought about in order to require the lowest possible energy consumption. As soon as the control unit picks up information, for example via further sensors (such as a vibration sensor or a microphone), the oscillation intensity can be increased or, conversely, decreased. Thus, for example, when using the drive system in a spring cradle for children, it is possible to react to restless behavior of the child and automatically adjust the operation of the drive unit. This is based on the assumption, observed in practice, that children fall asleep more easily when the vibration amplitude is higher. Furthermore, if the sensors detect restless behavior on the part of the child, a notification can be sent to a smartphone, for example as a push notification.

In addition to a harmonic oscillating movement, the control unit can realize any other movement patterns (e.g. oscillating patterns), which can be represented by upward and downward movements, by controlling the drive unit. An upward directed movement is limited by the fact that the load of the oscillating element cannot be further attracted against gravity by a maximum tensile force of the drive unit or an elastic element, if provided, is completely compressed or fully compressed. The downward directed motion is determined by the maximum deflection of the spring resulting from the installed safety cable of a spring or by the maximum length of the tension element. The maximum upward acceleration is determined by the maximum tensile force of the drive unit, and the maximum downward acceleration is determined by gravity. The maximum damping of a downward movement is determined by the maximum tensile force of the drive unit. Due to this feature in combination with a very fast controllability of the drive unit, a variety of different motion patterns can be executed. Furthermore, additional output means can be provided on the drive system such as loudspeakers or lights. For example, music or individually recorded audio files can be played through the speakers. The user can specify that the playback of an audio file or a light show can occur depending on the activity of the child. For this purpose, the drive unit can take into account all available sensor data to register an activity of the child in the cradle (such as acceleration and braking pulses characteristic of a hip swing or turning of the child). From this, an activity index (for example, 0-5) can be calculated, which provides an indication of the child's restlessness. The user can configure from which value of the activity index he wants to be notified—for example to be able to be on site in time when the child wakes up. Furthermore, the user can configure that audio files or light shows are played from a certain activity index. The output means can also be controlled by the control unit in order to be able to realistically simulate situations together with the movement patterns.

For example, a car journey can thus be simulated. In addition to the storage of a corresponding control of the drive unit by the control unit, the drive system can communicate via an interface with an app that allows the user to record a car ride. This takes into account the empirical values that children respond differently to different driving profiles. The app can record vehicle sounds, vibrations and brightness profiles (caused by passing lanterns, for example). The user can select parts of the recording, if necessary, hide measurement data such as brightness and transfer it to the drive system. The latter can play back this profile by the control unit controlling the drive unit and/or the output means accordingly in order to simulate vibrations, noises and/or light profiles (e.g. from passing lanterns).

The control of the drive unit, i.e. all actions (on, off, faster, slower, . . . ), the playing of motion patterns, can be done via any connected or connected interfaces (interaction mechanisms), such as a touch display, a mobile app or integration with voice assistants (e.g. Alexa or Siri). These interaction mechanisms can also be used to communicate feedback, information, and notifications.

Preferably, the drive system has an energy storage device configured to supply energy to the drive unit and the control unit. In other words, the drive unit may have a built-in energy storage device (for example, a rechargeable battery) to ensure wireless operation. This enables mobile use without a power supply unit and ensures continued operation in the event of an interrupted power supply, for example in the event of a power failure. In this context, the control unit can be designed to adapt the oscillation intensity to the remaining battery capacity in such a way that the desired remaining oscillation time, which can be set via a timer, for example, is achieved as far as possible.

Preferably, the drive system is controlled via a mobile app that communicates with the drive system via Bluetooth or WLAN. According to one aspect of the invention, a simple pairing via Bluetooth is provided, wherein by pressing one or more controls on the drive unit or a touch display, the pairing mode of the drive system can be activated. In a preferred embodiment, a touch display for controlling the drive system is detachable from the drive system so that it can be arranged in an ergonomic position. It can be connected to the drive system via cable or radio.

Preferably, the drive system comprises at least one resettable element connecting the drive system to the oscillating element.

The resettable element can be a spring or other element that can deform elastically. In other words, the elastic element can deform when a load is applied and return to its original position after the load is removed.

Elastic elements (e.g. springs) can be characterized by their spring constant, for example. Furthermore, the resettable element can be defined by a pretensioning force and/or a number of installed springs. In a preferred embodiment, different springs with a pretensioning force of 5N per spring and different spring constants may be used. The spring constants give the resulting spring travel in conjunction with the loading force. The spring constants result from the loading force and the resulting spring travel.

The drive system can be operated with different elastic elements. The springs can be used by cumulation or substitution between the drive system and the oscillating element. Different springs can, for example, be assigned different weights to be included in the oscillating element (for example, basic spring 3-5 kg, each additional supplementary spring +1 kg). The control unit can identify which springs are used based on the applied tensile force in conjunction with the amplitude deflection and oscillating frequency. Furthermore, the control unit can determine whether the springs used match the working weight. An individual definition of an optimum oscillating movement together with a tolerance range can be stored in the control unit. If there is a deviation, depending on the degree of deviation, the user is notified (flashing LED, notification in a mobile app (especially push notification), Alexa notification, etc.) and, if necessary, operation is also refused.

The user can add further accessories (such as further springs) as well as further functions. To do this, the user can link his drive unit to his profile, which may be stored on an operator's website.

Preferably, the control unit is designed to automatically detect characteristics of the resettable element and to control the drive unit based thereon.

In the preferred embodiment, the resettable element can be varied for different loads that may be applied to the oscillating element. The control unit can be designed to detect different resettable elements and determine their parameters. These parameters, in particular the spring constants, can then be stored by the control unit as configuration parameters and taken into account when controlling the drive unit. Thus, different resettable elements can be used without the need to manually enter parameters of the new resettable elements into the drive system. Rather, the drive system (in particular, the control unit) can automatically recognize a resettable element and its parameters and automatically adjust the operation accordingly. Thus, the use of the drive system may be simplified.

The spring constant (spring cureness) or the spring characteristic curve can be used as parameters of the element capable of restoring (for example a spring). These describe the relationship between deformation (displacement s or angle (p) and force F or torque Mt. The spring characteristic, like Hooke's law on which it is based, is usually linear to a good approximation and can in this case be characterized by means of a spring constant (as its slope). According to one aspect of the invention, a resettable element having a non-linear characteristic may be used. In this regard, it has been found that, particularly when the drive system is used to drive a baby spring cradle, a non-linear characteristic results in an oscillatory pattern that rapidly leads to a calming of the child received in the oscillating element.

Preferably, the drive system comprises a recuperation device designed to recover energy from the oscillating motion of the oscillating element.

Preferably, the drive system may include a drive unit having a guided track for the tension element, a guide for the tension element, and a mechanical lock, and the recuperation device. The recuperation device may be an electric machine that is driven by the tension element when the oscillating element moves away from the drive system. In other words, the recuperation device may be driven when the oscillating element is moved by the gravitational force of the earth. Thus, in this case, an elastic oscillating element can be dispensed with. As a result, the drive system can be implemented in a more compact manner, since there is no need for a resettable element to be connected to the drive system and the oscillating element.

According to another aspect of the present invention, spring cradle system is provided comprising:

one of the above drive systems, which can be arranged in a fixed position, and an oscillating element for receiving at least one person, wherein the oscillating element is fixed or fixable to the tension element.

The oscillating element may comprise a stretcher or cradle and a suspension element, wherein the stretcher or cradle may be a cloth or a dimensionally stable couch that is suspended or suspendable from the suspension element. The stretcher may accommodate at least one person (e.g., a child or baby). The spring cradle system may be equipped with a tilt sensor. Preferably, the tilt sensor is arranged on the oscillating element or the tension element. Thus, the control unit can detect information about the position of the oscillating element and control the drive unit based on this information. Further, the spring cradle system may comprise a roller mounted on a frame on which at least the oscillating element is suspended. The tension element may be guided over the roller and connected to the drive unit and to the oscillating unit, such that a force vector of the tension element is oriented inclined to the vertical. Preferably, the force vector transmitted from the tension element to the oscillating unit is inclined at an angle of about 45°. Thus, a rocking oscillation can advantageously be initiated. The drive system can be fixable to a stationary point (e.g. a door frame or a rack). For this purpose, the spring cradle system can have a fastening mechanism. The oscillating element may be tethered below the drive system by the tension element and optionally by a resettable element to the drive system. Since the payload-carrying drive unit is always on an axis with the resettable element and thus the payload, the tilt sensor provides input data to achieve a harmonic oscillating motion by an appropriate force control. Analogous to the above, the control unit can also perform a cool-down, stand-by and emergency stop function during the oscillating movement.

The spring cradle system can be used as a baby spring cradle system. Furthermore, the spring cradle system can also be used by adults.

Preferably, the spring cradle system comprises at least one sensor configured to detect a state of the at least one person accommodated in the oscillating element, wherein the control unit is configured to control the drive unit based on the detected state and/or to output the state of the at least one person to an output unit.

For example, the sensor may include a thermal imaging camera that detects that the person captured in the oscillating element is too cold or too warm and informs a user. Further, the sensor may comprise a vibration sensor and/or a microphone so that an activity of the person can be recorded. Based on this sensor data, the control unit can control and adjust the operation of the drive unit. Furthermore, the control unit can record and store different reactions of the person to different oscillation patterns and thus generate empirical data on which oscillation pattern causes which reactions of the person to occur most frequently. For example, in the case of babies, the control unit may determine which oscillation pattern results in the baby calming down or falling asleep. Further, using empirical data and/or the sensor data, the control unit may determine and display to a user an average sleep duration for the person. The user may be notified of conditions and/or expected events via push notification or Alexa notification so that the user can be at the spring cradle system in a timely manner, for example, before a baby wakes up. Further, the sensor may include a moisture sensor that detects, for example, that a baby has full diapers. This information can also be communicated to a user, for example via a display on the spring cradle system and/or via an interface, in particular wirelessly, to a mobile device.

In particular, in order to be able to make the above determinations, the control unit may comprise an artificial intelligence that can monitor all sensor data to gain knowledge about the state or behavior of the person recorded in the oscillating element and cause actions to be taken. For example, the artificial intelligence may be an artificial neural network that can be trained by using the information about the oscillating motion of the oscillating element as input data and using the responses of the person received in the oscillating element as output data. The neural network can be trained in an individualized manner for each user by constantly retraining or untraining it when the spring cradle system is used. Thus, the one control of the spring cradle system can be individually adapted.

Thus, the control unit can use rule-based technology or artificial intelligence to determine the optimal parameters for automated operation, taking into account the occurring boundary conditions, and control the control unit accordingly. In a preferred embodiment, the automated operation optimizes the oscillation intensity so that it applies only the minimum amount of movement to maintain a restful sleep. If restless behavior of a child is detected, for example, the oscillation intensity can be temporarily (i.e., intermittently) increased. Further, a higher oscillation intensity may be exerted at the beginning of the movement period. For example, the control unit can learn movement patterns that lead to particularly calm sleep of the child. The learned movement patterns can be distinguished for short sleep phases (nap) and long sleep phases (night). The activity index mentioned above can provide a data basis for the learning automatic operation.

Automatic operation can reduce a possible habituation effect of a child to the oscillating motion. Automatic operation can also be started in a mode in which the intensity of the movement is successively reduced to promote the child's becoming accustomed to the oscillating movement.

In addition, the control unit can send sensor data anonymously to a central Internet service to retrieve empirical values from installations of other spring cradle systems on similar sensor data in order to accelerate its own learning (through more available training data).

According to another aspect of the present invention, there is provided a method of simulating an elastic tension element, comprising the steps of:

a) providing a drive system comprising a tension element having a distal end adapted to be attached to an oscillating element, and a drive unit adapted to increase and/or decrease a free length of the tension element to change a position of the oscillating element relative to the drive system,
b) operating the drive unit so that a preload is applied to the tension element to simulate an elastic tension element,
c) determining that the distal end of the tension element is not moving toward the drive unit, and
d) finishing the simulation of the elastic tension element.

Thus, a mechanical tension element can be dispensed with, since the inventive method can simulate such a tension element by selectively controlling the drive unit. Thus, the same advantages can be achieved by the method as by the above device and a particularly quiet and efficient operation of a spring cradle can be achieved.

Preferably, the method further comprises the following steps:

e) operating the drive unit to initiate an oscillating motion of the oscillating element such that the distal end of the tension element moves away from the drive unit,
f) determining that the distal end of the tension element is no longer moving away from the drive unit, and
g) operating the drive unit so that the preload is applied to the tension element to simulate an elastic tension element.

All advantages of the method apply analogously to the device and vice versa. Further, individual aspects of embodiments may be combined with other aspects of other embodiments to form new embodiments.

In the following, embodiments of the present invention are described in detail with reference to the accompanying drawings. Thereby shows FIG. 1 a schematic representation of a drive system according to one embodiment of the present invention in use with a spring cradle system, FIG. 2 a schematic representation of a drive system according to a further embodiment of the present invention in use with a spring cradle system, FIG. 3 a schematic representation of a drive system according to a further embodiment of the present invention in use with a spring cradle system, FIG. 4 a schematic representation of a drive system according to a further embodiment of the present invention in use with a spring cradle system, FIG. 5 a schematic representation of a drive system according to a further embodiment of the present invention in use with a spring cradle system, FIG. 6 a schematic representation of a drive system according to a further embodiment of the present invention in use with a spring cradle system, FIG. 7 a schematic representation of a drive system according to a further embodiment of the present invention in use with a spring cradle system, and FIG. 8 a schematic representation of a spring cradle system according to one embodiment of the present invention.

FIG. 1 is a schematic representation of a spring cradle system 100. The spring cradle system comprises a drive system 2 according to a further embodiment of the present invention. In the present embodiment, the spring cradle system 100 can be suspended in a stationary manner by means of a fixation 1. For example, the spring cradle system 100 can be suspended from a hook on a ceiling, a door frame and/or a rack. The drive system 2 is connected to the fixation 1 such that the drive system 2 hangs below the fixation 1 in the operating state. The spring cradle system 100 further comprises a tension element 4 and a resettable element 3. In the embodiment shown in FIG. 1, the resettable element is a spring. In another embodiment not shown, the resettable element is an elastic element comprising a stretchable material (such as rubber or elastomer) and is capable of elastically varying its length. The tension element and the elastic element 3 are both fixed to the drive system 2 so that they hang below the drive system 2 in the operating state. Attached to the tension element 4 and the elastic element 3 is a suspension element 5, which serves as part of the oscillating element. On the suspension element 5, in turn, a stretcher or cradle 6 is arranged (for example, suspended), in which a person (for example, a baby, child) can be seated. Thus, the stretcher 6 and the suspension element 5 together form the oscillating element.

The tension element 4 can be shortened by a drive unit 21 (see FIG. 2) accommodated in the drive system 2 so that a distance between the oscillating element and the drive system 2 is reduced. In the present embodiment, the tension element is rolled and unrolled on a roller 7 (not shown in FIG. 1) to vary the distance between the drive system 2 and the oscillating element. By subsequently releasing the tension element 4, the oscillating element can again move away from the drive system 2 due to the force of gravity. In this case, the tension element 4 does not exert any force on the oscillating element. The elastic element 3 deforms elastically, slowing down the movement of the oscillating element to a standstill. Subsequently, the elastic element 3 exerts a force on the oscillating element opposite to the previous movement, so that the oscillating element moves back towards the drive system 2 in a return movement. During the backward movement, the tension element 4 does not exert any force on the oscillating element. Thus, an oscillation of the oscillating element can be initiated.

In order to be able to maintain the oscillation by periodically tightening the tension element 4, the tension element 4 must always be kept under tension. In other words, the tension element 4 should not sag, so that direct tightening of the oscillating element is possible by rolling up the tension element 4. In the prior art, a tensioned tension element is provided by a mechanical clamping element. In this case, the mechanical clamping element is usually a spiral spring on a shaft of the drive unit 21. In the present invention, this mechanical clamping element is simulated by selectively operating the drive unit 21. Thus, a free length of the tension element 4 is shortened during an upward movement of the oscillating element (i.e., during a movement toward the drive system 2) such that the tension element is always tensioned between the drive system and the oscillating element. This ensures that the movement of the oscillating element can be acted upon directly when the drive unit is operated. In this way, even complex oscillation patterns can be realized by selective operation of the drive unit 21. In the same way, a harmonic oscillation that is maintained constant, for example, can also be provided.

Figure 2:
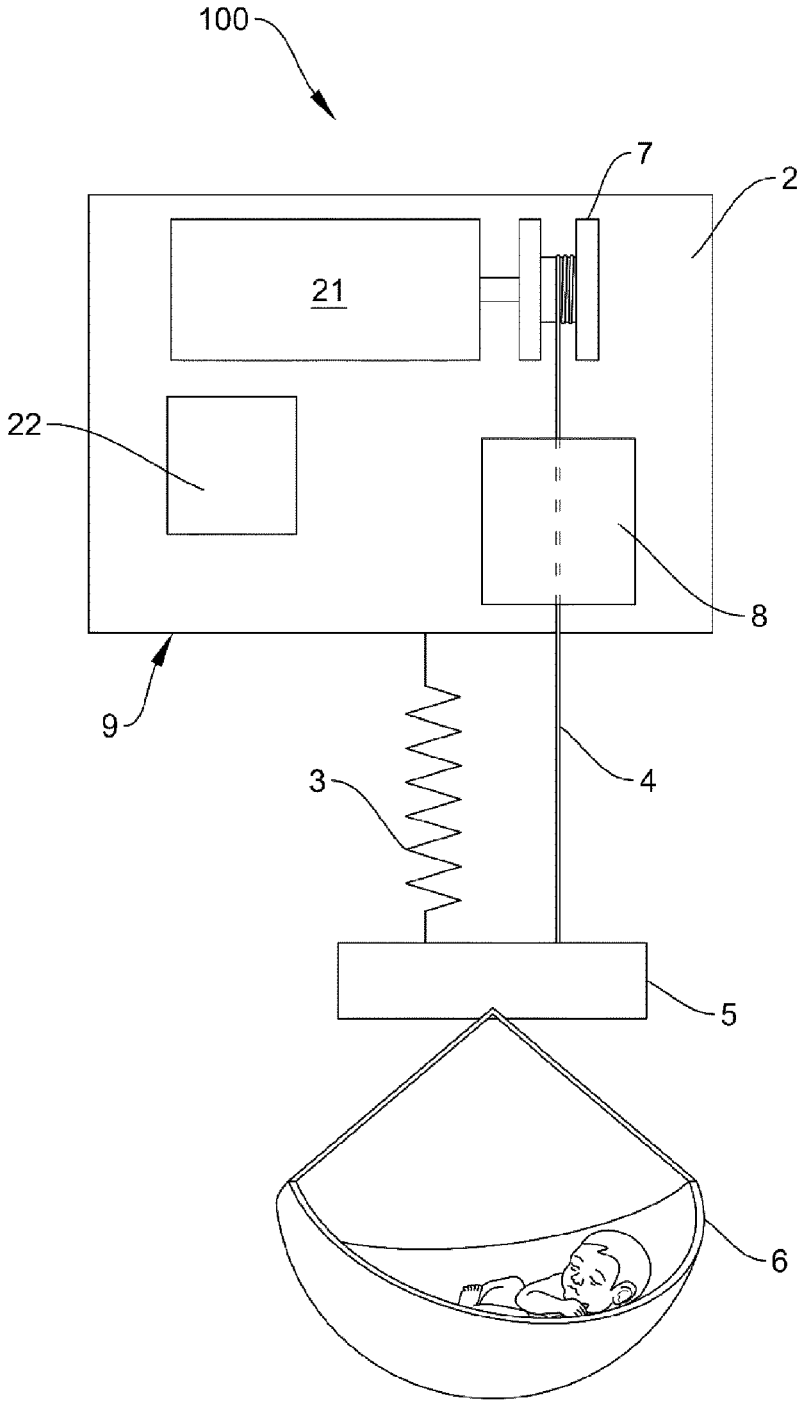

FIG. 2 is a schematic representation of the spring cradle system 100 according to a further embodiment of the present invention. In contrast to FIG. 1, in FIG. 2 a housing 9 of the drive system is cut away so that the elements shown in the drive system 2 are visible. For example, the roller 7, which can be rotationally driven by the drive unit 21 and around which the tension element 4 can be wound and unwound, is shown. Furthermore, in the present embodiment, a motion sensor 8 is arranged in the housing 9 of the drive system. The motion sensor 8 is designed to detect a movement of the tension element 4. In doing so, the motion sensor 8 can detect a movement amount and a movement direction. Thus, a control unit 22, which is also arranged in the drive system, can conclude the position of the oscillating element relative to the drive system 2. Consequently, the drive unit 21 can be controlled with high precision to realize predetermined oscillation patterns on the one hand and to keep the tension element 4 under tension at all times on the other hand. In the present embodiment, the tension element 4 is guided by the sensor 8. For example, the sensor can be provided with two measuring rollers between which the tension element is clamped. The rotation of these measuring rollers enables the sensor to detect a movement of the tension element 4.

Figure 3:
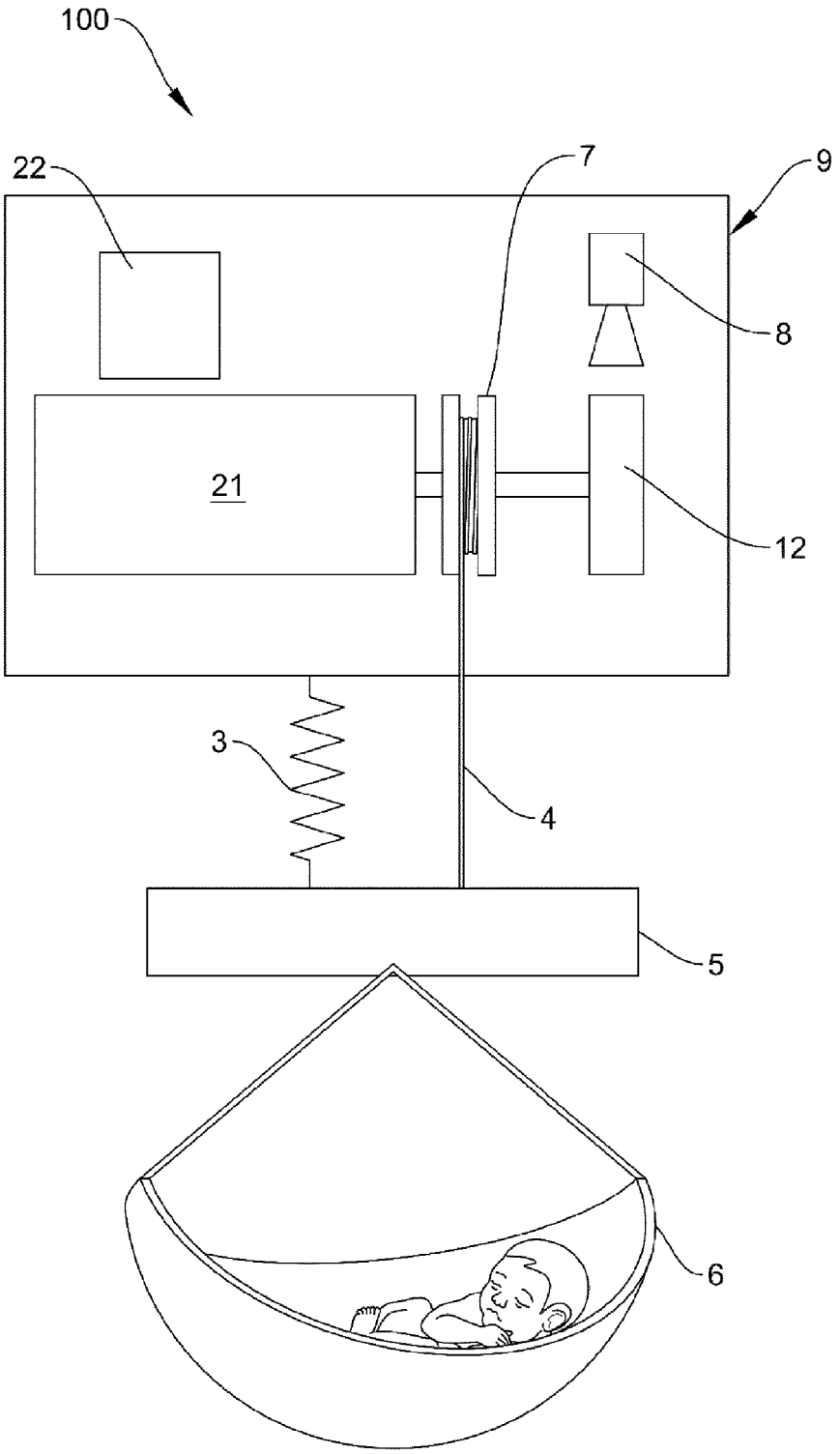

FIG. 3 is a schematic representation of the spring cradle system 100 according to another embodiment of the present invention. The embodiment shown in FIG. 3 corresponds to the embodiment shown in FIG. 2, except that the motion sensor 8 in the present embodiment is a non-mechanical sensor. In other words, the sensor 8 may be an optical sensor or an electromagnetic sensor. Therefore, an operation of the drive system 2 may be particularly quiet and low in closure. In this regard, the sensor 8 may, for example, be directed to a pole wheel 12 mounted to the shaft of the drive unit 21. The pole wheel 12 may have regular recesses that can be detected by the sensor 8. Further, the pole wheel may have magnetized elements that can be sensed by the sensor 8. In this case, the sensor 8 may be a Hall sensor.

Figure 4:
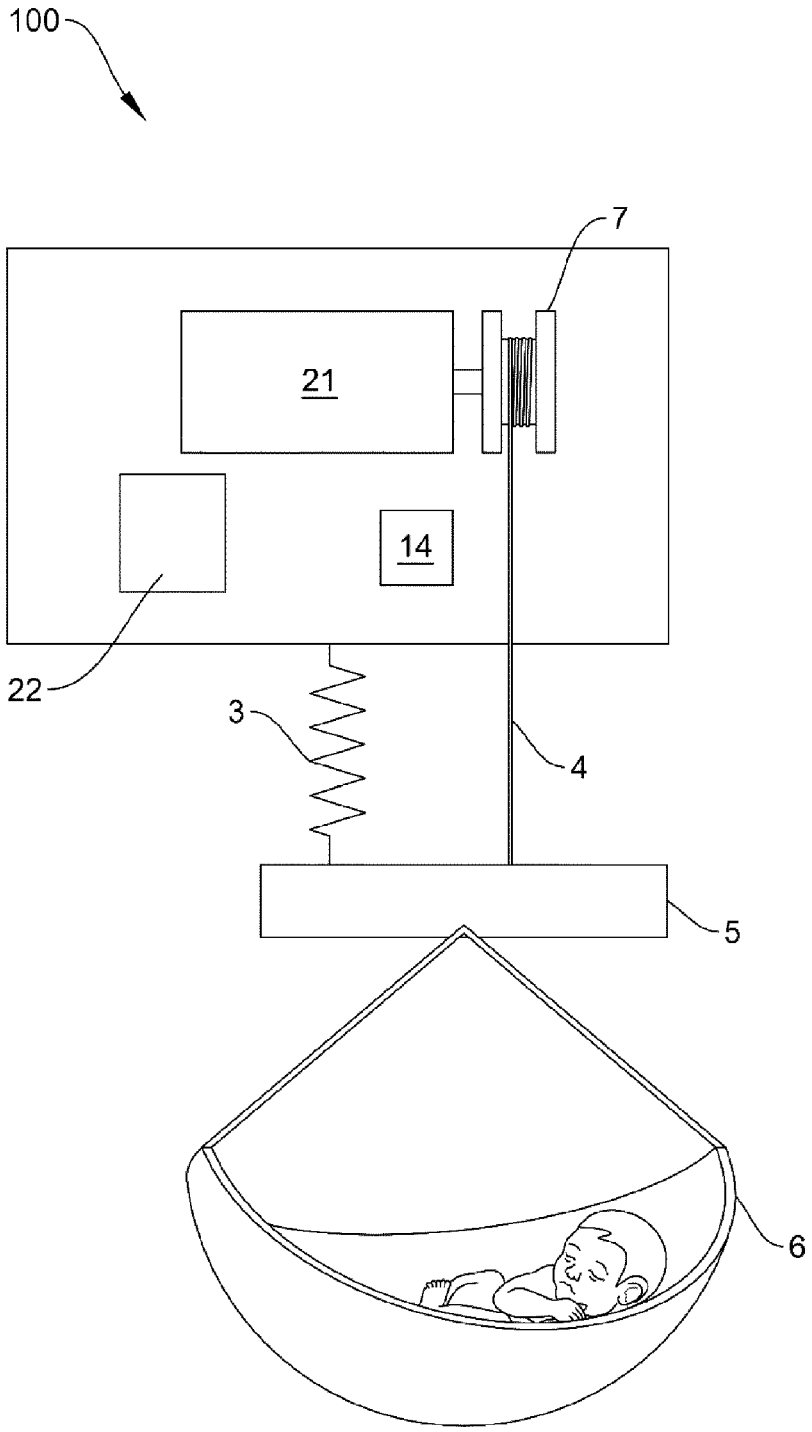

FIG. 4 is a schematic representation of the spring cradle system 100 according to a further embodiment of the present invention. Here, the present embodiment comprises additional or alternative sensors 14 to the sensors of the above embodiments for recording information of a person accommodated in the stretcher. For example, the sensors 14 may comprise a vibration sensor. This can be used to detect movement of the person in the stretcher 6. In particular, due to the connection between the drive system 2 and the oscillating system being kept under tension by the tension element 4, movements of the person in the stretcher 6 can be transmitted to the drive system 2. Thereupon, the control unit 22 can adjust the operation of the drive unit 21 to the detected vibrations. If, for example, vibration is detected by sensors 14 in response to an unsteady behavior of a child picked up in the stretcher 6, the oscillation intensity can be increased or, conversely, decreased. This is based on the assumption, observed in practice, that children fall asleep more easily when the oscillation amplitude is higher. Furthermore, if restless behavior of the person is detected by the sensors 14, a notification can be sent to a smartphone, for example as a push notification.

Figure 5:
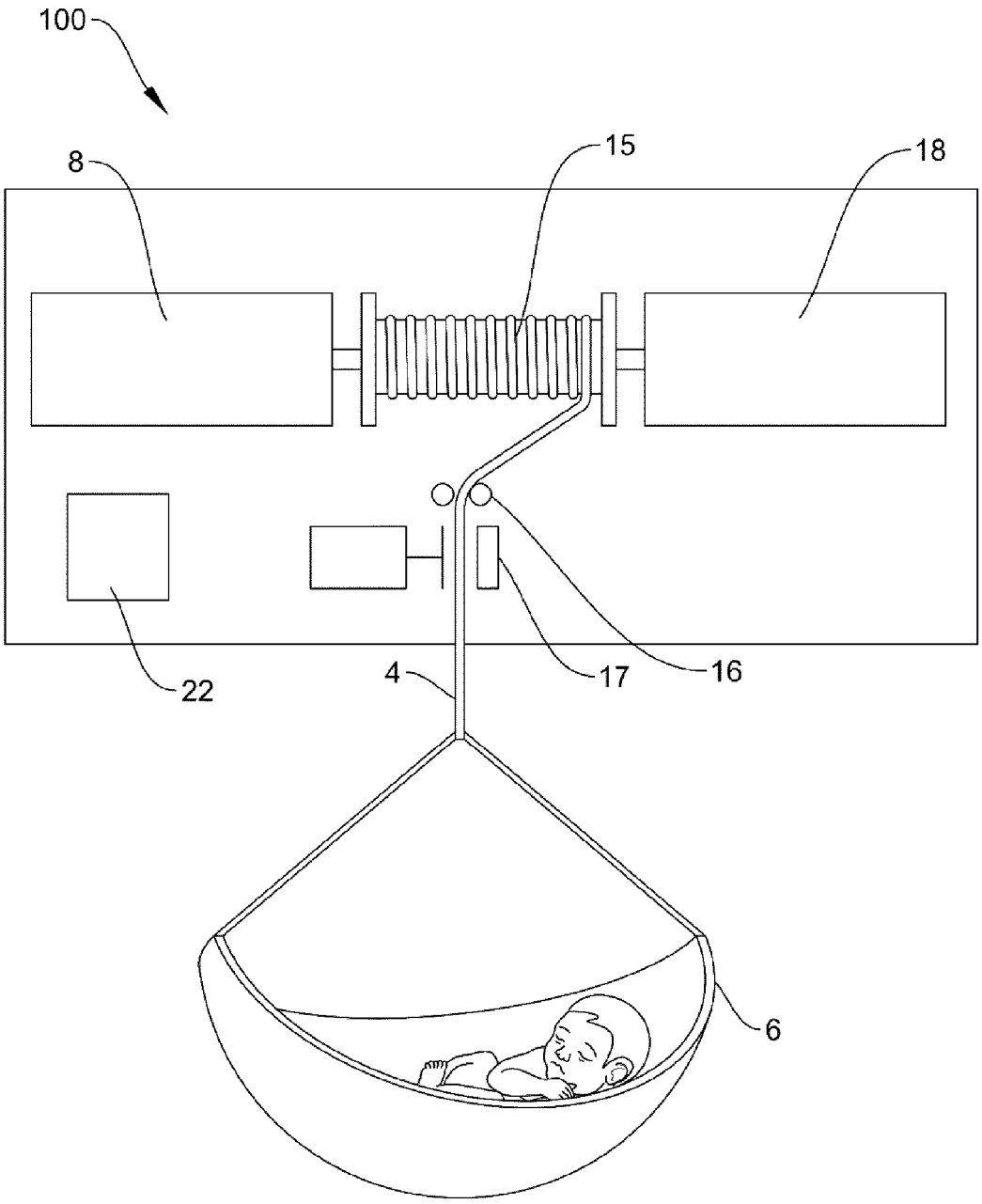

FIG. 5 is a schematic representation of the spring cradle system 100 according to a further embodiment of the present invention. The present embodiment differs from the preceding embodiments in that no elastic element is provided here, but the oscillating element is connected to the drive system 2 only by means of a tension element 4. Furthermore, the drive system 2 has a roller 15 with a guide 16 for the tension element 4. In other words, the tension element 4 is specifically wound onto the roller 15 by the guide 16. Thus, a constant force can always be applied from the roller 15 to the tension element 4 and vice versa. As in the above embodiments, the roller 15 is driven by a drive unit (not shown in FIG. 5). Furthermore, a recuperation device 18 is provided in the drive system 2 and connected to the shaft on which the roller 15 is arranged. Thus, when the oscillating element moves away from the drive system 2 (i.e., driven by the gravitational force of the earth), energy can be recovered from the motion of the oscillating system. Furthermore, a motion sensor 8 in the form of a dynamo is connected to the shaft. Thus, the position of the oscillating element relative to the drive system can be reliably determined. In addition, this embodiment has a mechanical locking element 17 that is configured to hold the tension element 4 when, for example, no movement of the oscillating element is desired.

Figure 6:
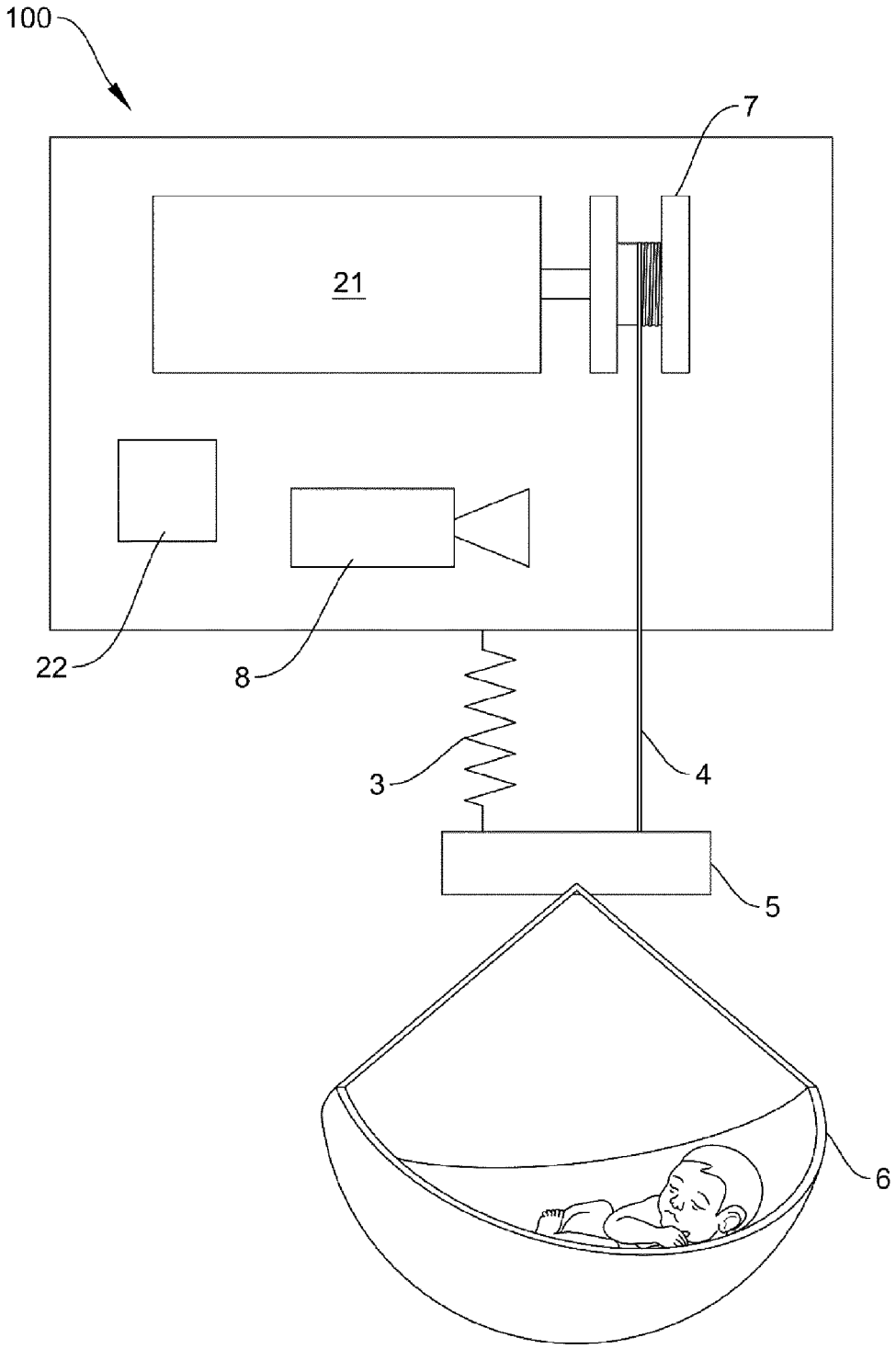

FIG. 6 is a schematic representation of the spring cradle system 100 according to a further embodiment of the present invention. This embodiment corresponds to the embodiments shown in FIGS. 2 to 4, with the difference that the motion sensor is directed directly at the tension element 4 and can register a movement of the tension element 4. In this case, the sensor is an ultrasonic sensor. Like the optical sensors mentioned above, this non-mechanical sensor has the advantage that an operation of the drive system 2 is very quiet and has low wear.

Figure 7:
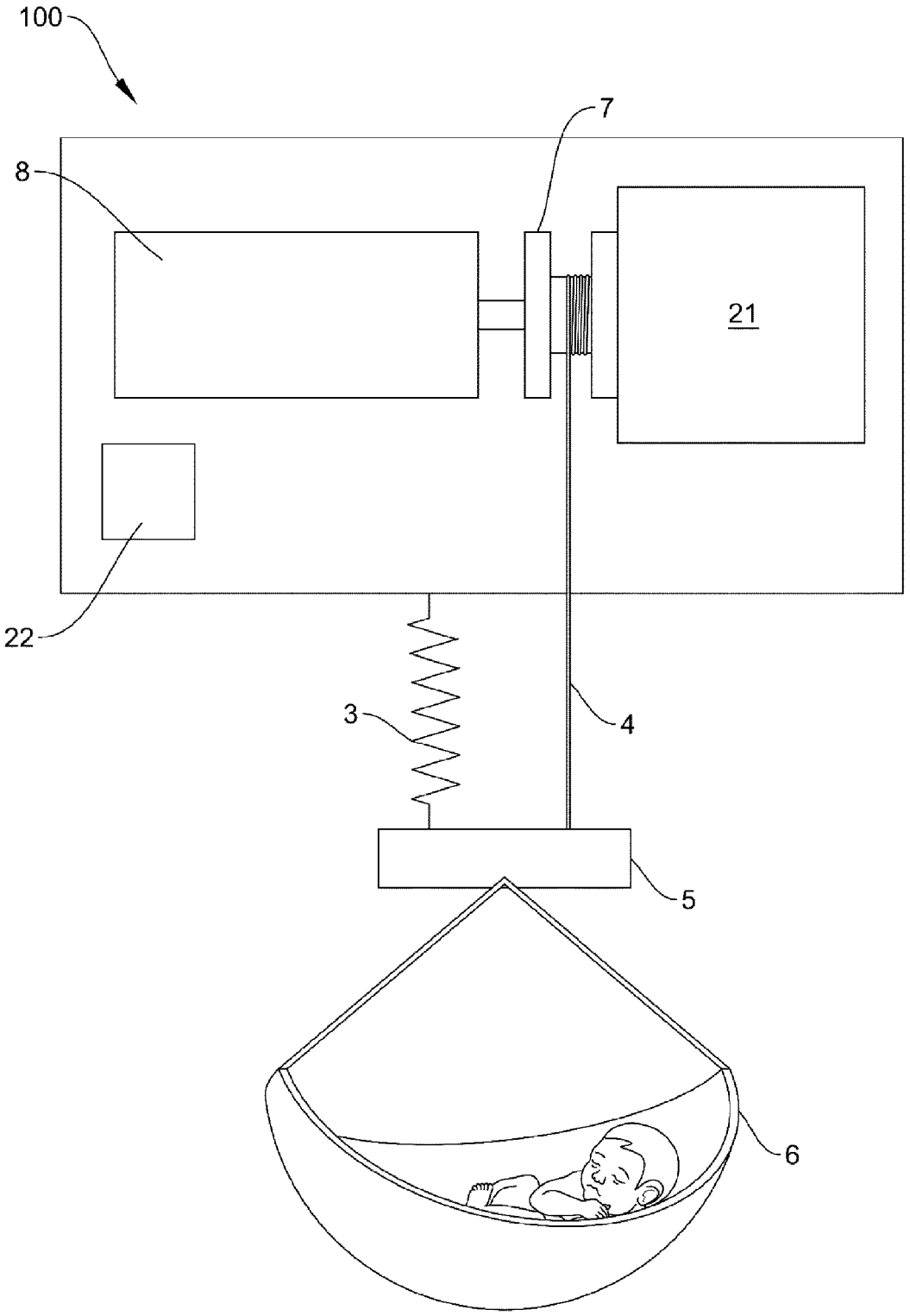

FIG. 7 is a schematic representation of the spring cradle system 100 according to a further embodiment of the present invention. This embodiment corresponds to the embodiments shown in FIGS. 2 to 4 and 6, with the difference that the motion sensor is configured as a dynamo located on the same shaft as the roller 7 and the drive unit 21. Consequently, movements of the roller 7 and thus of the tension element can be easily detected.

Figure 8:
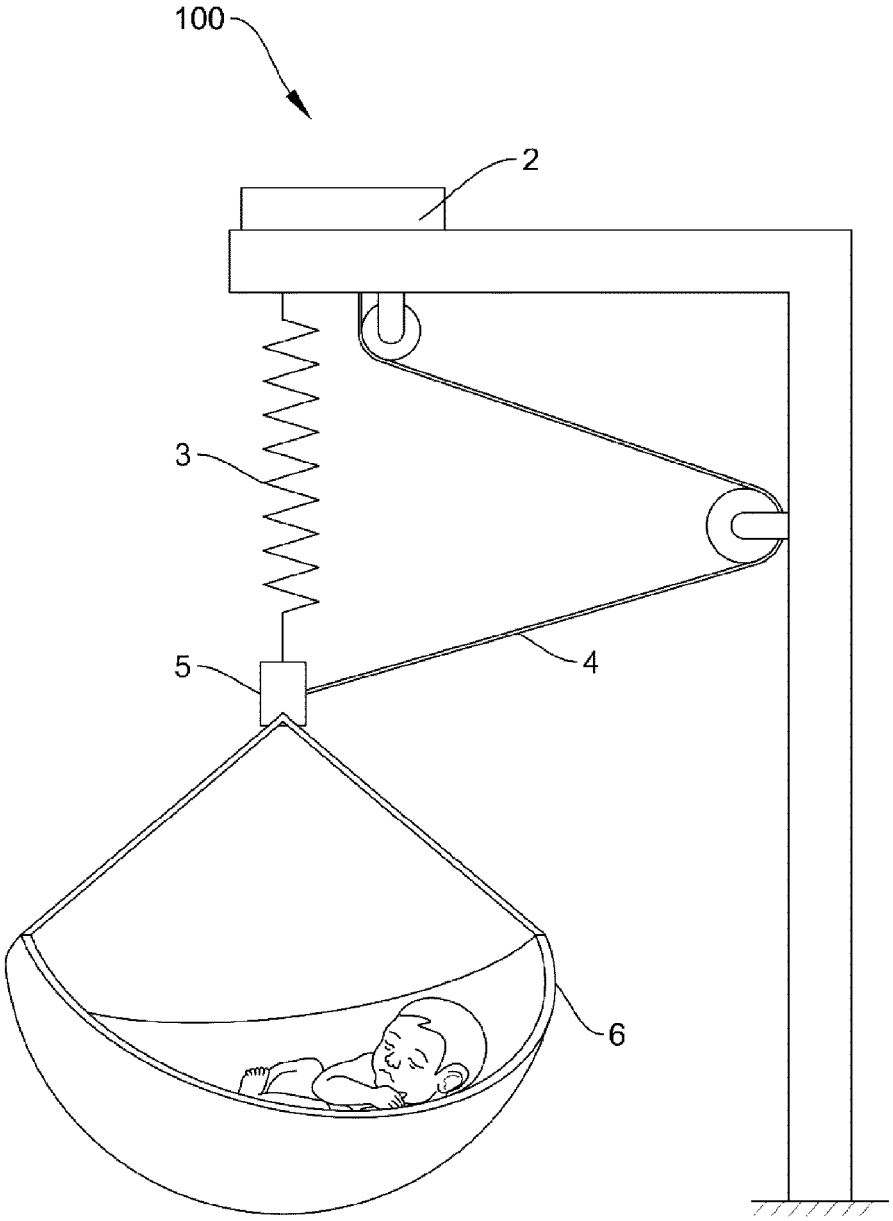

FIG. 8 is a schematic representation of a spring cradle system according to one embodiment of the present invention. Here, the tension element 4 is deflected by means of second deflection rollers so that the tension element 4 runs at an angle of about 45° relative to the horizontal from the drive system 2 to the suspension element 5. Furthermore, the stretcher 6 of the present embodiment has a tilt sensor. Thus, the control unit 22 can detect information about the position of the stretcher 6 and control the drive unit 21 based on this information. The deflection rollers are attached to a frame on which at least the oscillating element is suspended. Thus, an oscillating movement can be initiated by actuating the tension element 4.

LIST OF REFERENCE SIGNS

1 Fixation
2 Drive system
3 Resettable element
4 Tension element
5 Suspension element
6 Stretcher
7 Roller
8 Motion sensor
9 Housing

12 Pole wheel
14 Vibration sensor
15 Roller with guided track
16 Guide for tension element
17 Mechanical lock
18 Recuperation device
21 Drive unit
22 Control unit
100 Spring cradle system

The invention claimed is:

1. A drive system for a spring cradle system that generates an oscillating movement, the drive system comprising:

a tension element having a distal end adapted to be fixed to an oscillating element, wherein the tension element is a band-like element, a drive unit configured to increase and decrease a free length of the tension element to change a position of the oscillating element relative to the drive system, wherein the drive unit comprises a rotatable shaft configured to rotate causing the tension element to roll up over the rotatable shaft, a control unit configured to control the drive unit such that a pretensioning force acts on the tension element regardless of the position of the oscillating element relative to the drive system, wherein the pretensioning force is a tensile force for maintaining the tension of the tension element, and wherein the pretensioning force is less than 15% of a maximum power of the drive unit, and an electronic shutdown device, wherein at least one of the control unit or the drive unit are configured to periodically send operating signals to the electronic shutdown device at a predetermined time interval during operation, wherein the control unit is configured to send an emergency shutdown signal to the electronic shutdown device in response to receiving sensor readings that indicate a malfunction of the drive system, and wherein the electronic shutdown device is configured to automatically cut off a power supply to the drive unit when it does not receive the operating signals at the predetermined time interval or when it receives the emergency shutdown signal.

2. The drive system of claim 1, further comprising at least one sensor for determining a displacement of the distal end of the tension element, wherein the at least one sensor is a contactless sensor.

3. The drive system of claim 1, wherein the drive unit is configured to apply a variable force to the tension element.

4. The drive system of claim 1, wherein the drive system comprises an energy storage device configured to supply the drive unit and the control unit with energy.

5. The drive system of claim 1, wherein the control unit is further configured to control the drive unit such that the oscillating element performs a predetermined oscillating movement.

6. The drive system of claim 1, wherein the drive system comprises at least one resettable element connecting the drive system to the oscillating element.

7. The drive system of claim 1, wherein the control unit is configured to detect properties of the resettable element and to control the drive unit based thereon.

8. The drive system of claim 1, wherein the drive system comprises a recuperation device configured to recover energy from the oscillatory motion of the oscillating element.

9. The drive system of claim 1, wherein the tension element is provided on the drive system so as to extend away from a central point of the drive unit.

10. A spring cradle system comprising:

an oscillating element for receiving at least one person; and a drive system arranged in a fixed position, the drive system comprising:

a tension element having a distal end fastened to the oscillating element, wherein the tension element is a band-like element, a drive unit configured to increase and decrease a free length of the tension element to change a position of the oscillating element relative to the drive system, wherein the drive unit comprises a rotatable shaft configured to rotate causing the tension element to roll up over the rotatable shaft, a control unit configured to control the drive unit such that a pretensioning force acts on the tension element regardless of the position of the oscillating element relative to the drive system, wherein the pretensioning force is a tensile force for maintaining the tension of the tension element, and wherein the pretensioning force is less than 15% of a maximum power of the drive unit, and an electronic shutdown device, wherein at least one of the control unit or the drive unit are configured to periodically send operating signals to the electronic shutdown device during operation, wherein the electronic shutdown device is configured to automatically cut off the power supply to the drive unit when it is not receiving the operating signals, and wherein the electronic shutdown device is configured to automatically cut off the power supply to the drive unit when an emergency shutdown is initiated by the control unit in response to receiving sensor readings that indicate a malfunction of the drive system.

11. The spring cradle system of claim 10, further comprising at least one sensor configured to detect a state of the at least one person accommodated in the oscillating element, wherein the control unit is configured to control the drive unit based on the detected state and/or to output the state of the at least one person to an output unit.

12. A method for simulating an elastic clamping element, comprising the following steps:

providing a drive system comprising a tension element having a distal end adapted to be fixed to an oscillating element, a drive unit adapted to increase and/or decrease a free length of the tension element to change a position of the oscillating element relative to the drive system, a control unit configured to control the drive unit such that a pretensioning force acts on the tension element regardless of the position of the oscillating element relative to the drive system, and an electronic shutdown device, wherein the drive unit comprises a rotatable shaft over which the tension element is configured to be rolled up by rotation of the rotatable shaft, wherein at least one of the control unit and the drive unit are configured to periodically send operating signals to the electronic shutdown device during operation, wherein the electronic shutdown device is configured to automatically cut off a power supply to the drive unit when it is not periodically receiving the operating signals, and wherein the electronic shutdown device is configured to automatically cut off the power supply to the drive unit when an emergency shutdown is initiated by the control unit in response to receiving sensor readings indicating a malfunction of the drive system, operating the drive unit so that a pretension is applied to the tension element to simulate an elastic clamping element, determining that the distal end of the tension element does not move toward the drive unit, and finishing the simulation of the elastic clamping element, wherein the pretensioning force is a tensile force for maintaining the tension of the tension element, wherein the pretensioning force is less than 15% of a maximum power of the drive unit, and wherein the tension element is a band-like element.

13. The method of claim 12, wherein the method further comprises the steps of:

operating the drive unit to initiate an oscillating motion of the oscillating element such that the distal end of the tension element moves away from the drive unit, determining that the distal end of the tension element no longer moves away from the drive unit, and operating the drive unit so that the preload is applied to the tension element to simulate an elastic tension element.

* * * * *